US011060160B2

(12) United States Patent
Kondo et al.

(10) Patent No.: US 11,060,160 B2
(45) **Date of Patent: *Jul. 13, 2021**

(54) LOW-ALLOY STEEL FOR OIL WELL PIPE AND METHOD OF MANUFACTURING LOW-ALLOY STEEL OIL WELL PIPE

(71) Applicant: NIPPON STEEL & SUMITOMO METAL CORPORATION, Tokyo (JP)

(72) Inventors: Keiichi Kondo, Izumisano (JP); Yuji Arai, Amagasaki (JP); Takanori Sato, Kitaibaragi (JP)

(73) Assignee: NIPPON STEEL CORPORATION, Tokyo (JP)

( * ) Notice: Subject to any disclaimer, the term of this patent is extended or adjusted under 35 U.S.C. 154(b) by 1016 days.

This patent is subject to a terminal disclaimer.

(21) Appl. No.: 15/533,082

(22) PCT Filed: Dec. 4, 2015

(86) PCT No.: PCT/JP2015/084104
§ 371 (c)(1),
(2) Date: Jun. 5, 2017

(87) PCT Pub. No.: WO2016/093161
PCT Pub. Date: Jun. 16, 2016

(65) Prior Publication Data

US 2017/0362674 A1 Dec. 21, 2017

(30) Foreign Application Priority Data

Dec. 12, 2014 (JP) ..... JP2014-251565

(51) Int. Cl.
*C21D 9/08* (2006.01)
*C21D 8/10* (2006.01)
(Continued)

(52) U.S. Cl.
CPC ..... *C21D 9/08* (2013.01); *C21D 6/004* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS

| | | | | |
|---|---|---|---|---|
| 10,036,078 | B2 * | 7/2018 | Arai | B21B 3/00 |
| 2013/0061988 | A1 | 3/2013 | Delattre et al. | |
| 2018/0327881 | A1 * | 11/2018 | Yuga | C22C 38/00 |

FOREIGN PATENT DOCUMENTS

| | | |
|---|---|---|
| CA | 2 650 212 | 10/2008 |
| CA | 2 857 439 | 6/2013 |

(Continued)

*Primary Examiner* — Anthony J Zimmer
*Assistant Examiner* — Michael J Kachmarik
(74) *Attorney, Agent, or Firm* — Clark & Brody LP

(57) ABSTRACT

A low-alloy steel has a composition including, by mass %, C: more than 0.45 and up to 0.65%; Si: 0.05 to 0.50%; Mn: 0.10 to 1.00%; P: up to 0.020%; S: up to 0.0020%; Cu: up to 0.1%; Cr: 0.40 to 1.50%; Ni: up to 0.1%; Mo: 0.50 to 2.50%; Ti: up to 0.01%; V: 0.05 to 0.25%; Nb: 0.005 to 0.20%; Al: 0.010 to 0.100%; B: up to 0.0005%; Ca: 0 to 0.003%; 0: up to 0.01%; N: up to 0.007%; and other elements. A microstructure consists of tempered martensite and retained austenite <2% in volume fraction, crystal grain size number being 9.0 or larger, number density of carbonitride-based inclusions with grain diameter of 50 μm or larger being 10 inclusions/100 $mm^2$ or smaller, and yield strength being 965 MPa or higher.

9 Claims, 4 Drawing Sheets

(51) Int. Cl.

| | |
|---|---|
| ***C22C 38/00*** | (2006.01) |
| ***C22C 38/54*** | (2006.01) |
| ***C21D 6/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C21D 8/10* (2013.01); *C21D 8/105* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/001* (2013.01); *C21D 2211/008* (2013.01)

(56) References Cited

FOREIGN PATENT DOCUMENTS

| | | |
|---|---|---|
| CA | 2 955 170 | 1/2016 |
| CN | 101151387 | 3/2008 |
| CN | 102341522 | 2/2012 |
| EP | 1 862 561 | 12/2007 |
| EP | 3 026 139 | 6/2016 |
| JP | 62-54021 | 3/1987 |
| JP | 63-203748 | 8/1988 |
| JP | 2004-002978 | 1/2004 |
| JP | 2013-534563 | 9/2013 |
| JP | 53-33700 | 11/2013 |
| JP | 55-22322 | 6/2014 |
| WO | 2015/011917 | 1/2015 |

* cited by examiner

LOW-ALLOY STEEL FOR OIL WELL PIPE AND METHOD OF MANUFACTURING LOW-ALLOY STEEL OIL WELL PIPE

BACKGROUND

Technical Field

The present invention relates to a low-alloy steel for oil well pipe and a method of manufacturing a low-alloy steel oil well pipe and, more particularly, to a low-alloy steel for oil well pipe and a method of manufacturing a low-alloy steel oil well pipe with improved sulfide stress cracking resistance.

Description of the Background Art

An oil well pipe may be used as a casing or tubing for an oil well or gas well. As deeper and deeper oil wells or gas wells (oil wells and gas wells will be hereinafter referred to simply as "oil wells") are developed, an oil well pipe is required to have higher strength. Traditionally, oil well pipes in the 80 ksi grade (yield stress of 80 to 95 ksi, that is, 551 to 654 MPa) or in the 95 ksi grade (yield stress of 95 to 110 ksi, that is, 654 to 758 MPa) have been widely employed. Recently, however, oil well pipes in the 110 ksi grade (yield stress of 110 to 125 ksi, that is, 758 to 862 MPa) have begun to be employed, and the need for a still higher strength is expected to intensity.

Many deep oil wells that have been recently developed contain hydrogen sulfide, which is corrosive. As such, an oil well pipe is not only required to have high strength, but also have sulfide stress cracking resistance (hereinafter referred to as SSC resistance).

JP 2004-2978 A discloses a low-alloy steel with good pitting resistance. JP 2013-534563 A discloses a low-alloy steel with a yield strength that is not lower than 963 MPa. Japanese Patent No. 5522322 discloses a steel pipe for oil wells with a yield strength that is not lower than 758 MPa. Japanese Patent No. 5333700 discloses a low-alloy steel for oil wells with a yield strength that is not lower than 862 MPa. JP Sho62(1987)-54021 A describes a method of manufacturing a high-strength seamless steel pipe with a yield strength that is not lower than 75 kgf/mm$^2$. JP Sho63(1988)-203748 A discloses a high-strength steel with a yield strength that is not lower than 78 kgf/mm$^2$.

SUMMARY

It is known that tempering a steel at high temperatures improves the SSC resistance of the steel, since tempering at higher temperatures reduces the density of dislocations which present trap sites for hydrogen. However, reduced dislocation density means that the steel has decreased strength. Attempts have been made to increase the contents of alloy elements that increase temper softening resistance; however, there are limitations to such attempts.

SSC is more likely to occur in a steel with higher strength. There are cases where employing the techniques disclosed in the above Patent Documents cannot provide low-alloy steel oil well pipes having a yield strength that is not lower than 965 MPa with good SSC resistance in a stable manner.

An object of the present invention is to provide a low-alloy steel for oil well pipe and a method of manufacturing a low-alloy steel oil well pipe where high strengths and good SSC resistances can be provided in a stable manner.

A low-alloy steel for oil well pipe according to the present invention has a chemical composition consisting of, by mass percent, C: more than 0.45 and up to 0.65%; Si: 0.05 to 0.50%; Mn: 0.10 to 1.00%; P; up to 0.020%; S: up to 0.0020%; Cu: up to 0.1%; Cr: 0.40 to 1.50%; Ni: up to 0.1%; Mo: 0.50 to 2.50%; Ti: up to 0.01%; V: 0.05 to 0.25%; Nb: 0.005 to 0.20%; Al: 0.010 to 0.100%; B: up to 0.0005%; Ca: 0 to 0.003%; 0: up to 0.01%; N: up to 0.007%; and the balance: Fe and impurities, the steel having a microstructure consisting of tempered martensite and retained austenite in less than 2% in volume fraction, a crystal grain size number of prior austenite grains of the microstructure being 9.0 or larger, a number density of carbonitride-based inclusions with a grain diameter of 50 μm or larger being 10 inclusions/100 mm$^2$ or smaller, and a yield strength being 965 MPa or higher.

A method of manufacturing a low-alloy steel oil well pipe according to the present invention includes: preparing a raw material having a chemical composition consisting of, by mass percent, C: more than 0.45 and up to 0.65%; Si: 0.05 to 0.50% Mn: 0.10 to 1.00%; up to 0.020%; S: up to 0.0020%; Cu: up to 0.1%; Cr: 0.40 to 1.50%; Ni: up to 0.1%; Mo: 0.50 to 2.50%; Ti: up to 0.01%; V; 0.05 to 0.25%; Nb: 0.005 to 0.20%; Al: 0.010 to 0.100%; B: up to 0.0005%; Ca: 0 to 0.003%; 0: up to 0.01%; N: up to 0.007%; and the balance: Fe and impurities; casting the raw material to produce a cast material; hot working the cast material to produce a hollow shell; quenching the hollow shell; and tempering the quenched hollow shell. In the casting, a cooling rate for a temperature range of 1500 to 1000° C. at a position of ¼ of a wall thickness of the cast material is 10° C./min or higher.

The present invention provides a low-alloy steel for oil well pipe and a low-alloy steel oil well pipe where high strengths and good SSC resistances can be provided in a stable manner.

DESCRIPTION OF THE EMBODIMENTS

Figure 1A:
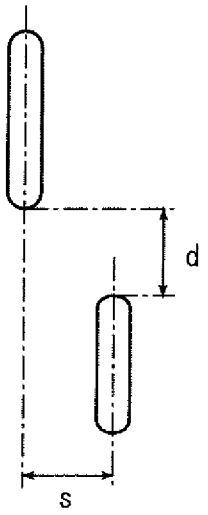
FIG. 1A illustrates clustered inclusions.

The present inventors made extensive research on the strength and SSC resistance of low-alloy steel for oil well pipe and obtained the following findings (a) to (e).

(a) To achieve high strength and good SSC resistance in a stable manner, the use of a steel with high C content is effective. Increased C content improves the hardenability of the steel and increases the amount of carbide precipitating in the steel. This improves the strength of the steel independently from dislocation density.

(b) To achieve good SSC resistance in a stable manner, it is important to control the grain diameter of carbonitride-based inclusions. If coarse carbonitride-based inclusions are present in a plastic region toward which a fissure is propagating, these inclusions may present initiation sites for cracks, facilitating the propagation of the fissure.

More specifically, good fracture toughness is achieved if the number density of carbonitride-based inclusions with a grain diameter of 50 μm or larger is up to 10 inclusions/100 $mm^2$. More preferably, in addition, the number density of carbonitride-based inclusions with a grain diameter of 5 μm or larger is up to 600 inclusions/100 $mm^2$. As used herein, carbonitride-based inclusion refers to $B_2$-type inclusions and $C_2$-type inclusions as specified in JIS G 0555 (2003), Appendix 1, Section 4.3 "Types of Inclusions".

The grain diameter of carbonitride-based inclusions can be controlled by the cooling rate encountered when casting the steel. More specifically, the cooling rate for the temperature range of 1500 to 1000° C. at a position of ¼ in the wall thickness of the cast material is 10° C./min or higher. If the cooling rate during this is too low, carbonitride-based inclusions become coarse. If the cooling rate during this is too high, cracks may develop on the surface of the cast material. Thus, the cooling rate is preferably 50° C./min or lower, and more preferably 30° C./min or lower.

(c) The low-alloy steel for oil well pipe is quenched and tempered after pipe fabrication to regulate the microstructure to be mainly composed of tempered martensite. If the volume fraction of retained austenite is high, it is difficult to achieve high strength in a stable manner. To achieve high strength in a stable manner, the volume fraction of retained austenite is made lower than 2%.

(d) Tempered martensite is composed of a plurality of prior austenite grains. The finer the prior austenite grains, the better SSC resistance can be achieved in a stable manner. More specifically, if the crystal grain size number of prior austenite grains in accordance with ASTM E112 is 9.0 or larger, good SSC resistances can be achieved in a stable manner even when the steel has a yield strength of 965 MPa or higher.

(e) To achieve still better SSC resistances, it is preferable if, in addition, the sub-structures in the prior austenite grains are made finer. More specifically, the equivalent circle diameter of the sub-structures defined below is preferably not larger than 3 μm.

Each prior austenite grain is formed by a plurality of packets. Each packet is formed by a plurality of blocks, and each block is formed by a plurality of laths. A packet boundary, block boundary and lath boundary with a crystal misorientation of 15° or larger will be referred to as "large-angle grain boundary". In tempered martensite, a region defined by packet boundaries, block boundaries and lath boundaries that are large-angle grain boundaries will be referred to as "sub-structure".

The equivalent circle diameter of sub-structures can be controlled by quenching conditions. More specifically, the quenching starting temperature is equal to or higher than $A_{C3}$ point, and the quenching stop temperature is not higher than 100° C. That is, after the hollow shell is heated to a temperature equal to or higher than $A_{C3}$ point, the heated hollow shell is cooled to a temperature that is not higher than 100° C. Further, during this cooling, the cooling rate for the temperature range from 500° C. to 100° C. is not lower than 1° C./sec and lower than 15° C./sec. This makes the equivalent circle diameter of the sub-structures equal to or smaller than 3 μm.

The present invention was made based on the above findings. A low-alloy steel for oil well pipe and a method of manufacturing a low-alloy steel oil well pipe in embodiments of the present invention will now be described in detail.

[Chemical Composition]

The low-alloy steel for oil well pipe in the present embodiment has the chemical composition described below. In the following description, "%" in a content of an element means mass percent.

C: more than 0.45 and up to 0.65%

Carbon (C) causes carbide to precipitate in steel to increase the strength of the steel. The carbide may be, for example, cementite or an alloy carbide (Mo carbide, V carbide, Nb carbide, Ti carbide, etc.). Further, carbon makes sub-structures smaller to increase SSC resistance. If the C content is too low, these effects cannot be achieved. If the C content is too high, the toughness of the steel decreases and the susceptibility to cracking increases. In view of this, the C content should be higher than 0.45 and not higher than 0.65%. The lower limit of C content is preferably 0.47%, and more preferably 0.50%, and still more preferably 0.55%. The upper limit of C content is preferably 0.62%, and more preferably 0.60%.

Si: 0.05 to 0.50%

Silicon (Si) deoxidizes steel. This effect cannot be achieved if the Si content is too low. If the Si content is too high, the SSC resistance decreases. In view of this, the Si content should be in the range of 0.05 to 0.50%. The lower limit of Si content is preferably 0.10%, and more preferably 0.20%. The upper limit of Si content is preferably 0.40%, and more preferably 0.35%.

Mn: 0.10 to 1.00%

Manganese (Mn) deoxidizes steel. This effect cannot be achieved if the Mn content is too low. If the Mn content is too high, it segregates along grain boundaries together with impurity elements such as phosphorous (P) and sulfur (S), decreasing the SSC resistance of the steel. In view of this, the Mn content should be in the range of 0.10 to 1.00%. The lower limit of Mn content is preferably 0.20%, and more preferably 0.28%. The upper limit of Mn content is preferably 0.80%, and more preferably 0.50%.

P: up to 0.020%

Phosphorus (P) is an impurity. P segregates along grain boundaries and decreases the SSC resistance of the steel. Thus, lower P contents are preferable. In view of this, the P content should be not higher than 0.020%. The P content is preferably not higher than 0.015%, and more preferably not higher than 0.012%.

S: up to 0.0020%

Sulphur (S) is an impurity. S segregates along grain boundaries and decreases the SSC resistance of the steel. Thus, lower S contents are preferable. In view of this, the S content should be not higher than 0.0020%. The S content is preferably not higher than 0.0015%, and more preferably not higher than 0.0010%.

Cr: 0.40 to 1.50%

Chromium (Cr) increases the hardenability of steel and increases the strength of the steel. If the Cr content is too high, the toughness of the steel decreases and the SSC resistance of the steel decreases. In view of this, the Cr content should be in the range of 0.40 to 1.50%. The lower limit of Cr content is preferably 0.45%. The upper limit of Cr content is preferably 1.30%, and more preferably 1.00%.

Mo: 0.50 to 2.50%

Molybdenum (Mo) forms a carbide and increases temper softening resistance. This effect cannot be achieved if the Mo content is too low. If the Mo content is too high, the steel is saturated with respect to this effect. In view of this, the Mo content should be in the range of 0.50 to 2.50%. The lower limit of Mo content is preferably 0.60%, and more preferably 0.65%. The upper limit of Mo content is preferably 2.0%, and more preferably 1.6%.

V: 0.05 to 0.25%

Vanadium (V) forms a carbide and increases temper softening resistance. These effects cannot be achieved if the V content is too low. If the V content is too high, the toughness of the steel decreases. In view of this, the V content should be in the range of 0.05 to 0.25%. The lower limit of V content is preferably 0.07%. The upper limit of V content is preferably 0.15%, and more preferably 0.12%.

Ti: up to 0.01%

Titanium (Ti) is an impurity. Ti forms carbonitride-based inclusions, making the SSC resistance of the steel unstable. Thus, lower Ti contents are preferable. In view of this, the Ti content should be not higher than 0.01%. The upper limit of Ti content is preferably 0.008%, and more preferably 0.006%.

Nb: 0.005 to 0.20%

Niobium (Nb) forms a carbide, nitride or carbonitride. These precipitates make the sub-structures of steel finer due to the pinning effect, increasing the SSC resistance of the steel. These effects cannot be achieved if the Nb content is too low. If the Nb content is too high, an excessive amount of carbonitride-based inclusions are produced, making the SSC resistance of the steel unstable. In view of this, the Nb content should be in the range of 0.005 to 0.20%. The lower limit of Nb content is preferably 0.010%, and more preferably 0.012%. The upper limit of Nb content is preferably 0.10% and more preferably 0.050%.

Al: 0.010 to 0.100%

Aluminum (Al) deoxidizes steel. If the Al content is too low, the steel is insufficiently deoxidized, decreasing the SSC resistance of the steel. If the Al content is too high, an oxide is produced, decreasing the SSC resistance of the steel. In view of this, the Al content should be in the range of 0.010 to 0.100%. The lower limit of the Al content is preferably 0.015%, and more preferably 0.020%. The upper limit of Al content is preferably 0.080%, and more preferably 0.050%. As used herein, the content of "Al" means the content of "acid-soluble Al", i.e. "sol. Al".

B: up to 0.0005%

Boron (B) is an impurity. B forms $M_{23}CB_G$ along grain boundaries, decreasing the SSC resistance of the steel. Thus, lower B contents are preferable. In view of this, the B content should be up to 0.0005%. The upper limit of B content is preferably 0.0003%, more preferably 0.0002%.

O: up to 0.01%

Oxygen (O) is an impurity. O forms coarse oxide particles or clusters of oxide particles, decreasing the toughness of the steel. Thus, lower O contents are preferable. In view of this, the O content should be not higher than 0.01%. The O content is preferably not higher than 0.005% and more preferably not higher than 0.003%.

N: up to 0.007%

Nitrogen (N) is an impurity. N forms a nitride, making the SSC resistance of the steel unstable. Thus, lower N contents are preferable. In view of this, the N content should be not higher than 0.007%. The N content is preferably not higher than 0.005%, and more preferably not higher than 0.004%.

Cu: up to 0.1%

Copper (Cu) is an impurity in the context of the present invention. Although Cu increases the hardenability of steel and strengthens the steel, a Cu content higher than 0.1% causes hardened structures to develop locally or cause uneven corrosion to occur on the surface of the steel. In view of this, the Cu content should be not higher than 0.1%. The Cu content is preferably not higher than 0.05% and more preferably not higher than 0.03%.

Ni: up to 0.1%

Nickel (Ni) is an impurity in the context of the present invention. Although Ni also increases the hardenability of steel and strengthens the steel, an Ni content higher than 0.1% decreases SSC resistance. In view of this, the Ni content should be not higher than 0.1%. The Ni content is preferably not higher than 0.05% and more preferably not higher than 0.03%.

The balance of the chemical composition of the low-alloy steel for oil well pipe is made of Fe and impurities. Impurity in this context means an element originating from ore or scraps used as raw material of steel or an element that has entered from the environment or the like during the manufacturing process.

[Optional Elements]

The low-alloy steel for oil well pipe in the present embodiment may contain Ca replacing some of the Fe discussed above.

Ca: 0 to 0.003%

Calcium (Ca) is an optional element. Ca bonds with S in steel to form a sulfide, improving the shape of inclusions to increase the toughness of the steel. Even a small Ca content provides the above effects. On the other hand, if the Ca content is too high, the steel is saturated with respect to this effect. In view of this, the Ca content should be in the range of 0 to 0.003%. The lower limit of Ca content is preferably 0.0005%, and more preferably 0.0010%. The upper limit of Ca content is preferably 0.0025%, and more preferably 0.0020%.

[Microstructure]

The microstructure of the low-alloy steel for oil well pipe in the present embodiment is mainly composed of tempered martensite. More specifically, the matrix of the microstructure is composed of tempered martensite and retained austenite in less than 2% in volume fraction.

The presence of a microstructure other than tempered martensite, such as bainite, makes the strength unstable. Since retained austenite causes variations in strength, lower volume fractions thereof are preferable. The volume fraction of retained austenite may be measured, for example, by X-ray diffraction method in the following manner: After a low-alloy steel oil well pipe is produced, a sample including a central portion thereof with respect to the wall thickness is obtained. The surface of the obtained sample is chemically polished. X-ray diffraction is performed on the chemically polished surface, using CoKα rays as incident X rays. The volume fraction of retained austenite is determined based on the integrated intensity of the (211) plane, (200) plane and (110) plane of the ferrite and the integrated intensity of the (220) plane, (200) plane and (111) plane of the austenite.

The crystal structure of the tempered martensite and bainite is the same BCC structure of the ferrite. As discussed above, the microstructure of the low-alloy steel for oil well pipe in the present embodiment is mainly composed of tempered martensite. As such, the integrated intensity of the (211) plane, (200) plane and (110) plane of the ferrite discussed above is a measure for the tempered martensite.

[Crystal Grain Size of Prior Austenite Grains]

The crystal grain size number of the prior austenite grains of the low-alloy steel for oil well pipe in the present embodiment is not smaller than 9.0. The crystal grain size number of prior austenite grains is measured in accordance with ASTM E112. If the crystal grain size number of prior austenite grains is not smaller than 9.0, a good SSC resistance can be achieved even when the steel has a yield strength of 965 MPa or higher. The crystal grain size number of prior austenite grains is preferably larger than 9.0, and more preferably 10.0 or larger.

The crystal grain size number of prior austenite grains may be measured in a steel after quenching and before tempering (i.e. so-called steel as-quenched), or may be measured in a tempered steel. The crystal grain size number of prior austenite grains remains the same regardless of which of these steels is used.

[Number Density of Carbonitride-Based Inclusions]

Further, in the low-alloy steel for oil well pipe in the present embodiment, the number density of carbonitride-based inclusions with a grain diameter that is not smaller than 50 pin is 10 inclusions/100 $mm^2$ or fewer. As discussed above, if coarse carbonitride-based inclusions are present in a plastic region toward which a fissure is propagating, these inclusions may present initiation sites for cracks, facilitating the propagation of the fissure. Thus, lower number densities of coarse inclusions are preferable. If the number of carbonitride-based inclusions with a grain diameter that is not smaller than 50 μm is 10 inclusions/100 $mm^2$ or fewer, good fracture toughness can be achieved.

The grain diameter and number density of inclusions may be measured in the following manner: A sample is obtained that includes a central portion with respect to the wall thickness in a cross-section parallel to the axial direction of the low-alloy steel oil well pipe and includes an observed region having an area of 100 $mm^2$. Mirror polishing is performed on a surface including the observed region (i.e. observed surface). On the observed surface of the polished sample, optical microscopy is used to identify inclusions in the observed region (i.e. sulfide-based inclusions (MnS, for example), oxide-based inclusions ($Al_2O_3$, for example) and carbonitride-based inclusions). More specifically, oxide-based inclusions, sulfide-based inclusions and carbonitride-based inclusions are identified in the observed region based on contrasts and shapes in optical microscopic images.

Figure 1B:
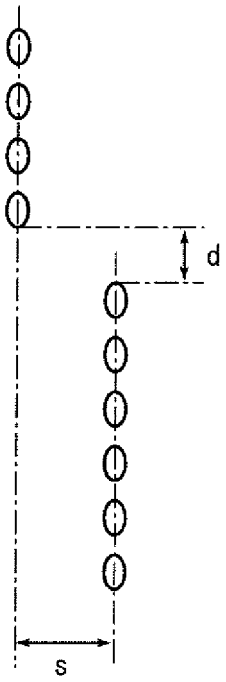
FIG. 1B illustrates clustered inclusions.

Carbonitride-based inclusions are selected from among the identified inclusions and their grain diameters are measured. As used herein, grain diameter means the length (μm) of the longest one of the straight lines each connecting two different points on the interface between an inclusion and the matrix. A group of clustered grains is considered as one inclusion when the grain diameter is determined. More specifically, as shown in FIGS. 1A and 1B, regardless of whether individual inclusions are aligned on a straight line, they are considered as one inclusion if the distance therebetween, d, is 40 μm or smaller and the distance between their centers, s, is 10 μm or smaller. A carbonitride-based inclusion with a grain diameter of 50 μm or larger will be referred to as coarse inclusion.

The total number of coarse inclusions in each observed region is counted. Then, the total number of coarse inclusions in all the observed regions, TN, is determined. Based on the total number TN that has been determined, the number density N of coarse inclusions for 100 $mm^2$ is determined by the following equation (A):

$$N = TN/\text{total area of observed regions} \times 100 \quad \text{(A).}$$

More preferably, in addition, the number density of carbonitride-based inclusions having a grain diameter of 5 μm or larger is 600 inclusions/100 $mm^2$ or smaller. The number density of carbonitride-based inclusions with a grain diameter of 5 μm or larger may be determined in a similar manner to that for the number density of carbonitride-based inclusions with a grain diameter of 50 μm or larger.

[Equivalent Circle Diameter of Sub-Structures]

In the low-alloy steel for oil well pipe in the present embodiment, the equivalent circle diameter of substructures defined by those boundaries between packets, blocks and laths in tempered martensite that have a crystal misorientation of 15° or larger is preferably 3 μm or smaller.

In a steel having a high strength of 965 MPa or higher, the SSC resistance depends on not only the grain diameter of prior austenite grains but on the size of sub-structures. If the crystal grain size number of prior austenite grains is 9.0 or larger and the equivalent circle diameter of sub-structures is 3 μm or smaller, good SSC resistances can be achieved in a stable manner in a low-alloy steel for oil well pipe having a high strength of 965 MPa or higher. More preferably, the equivalent circle diameter of sub-structures is 2.5 μm or smaller, and yet more preferably 2.0 μm or smaller.

The equivalent circle diameter of sub-structures may be measured in the following manner: A sample is obtained that has an observed surface having an area of 100 μm×100 μm whose center is aligned with a center in the wall thickness in a cross-section perpendicular to the axial direction of the low-alloy steel oil well pipe. Crystal orientation analysis is performed on the above observed surface by the electron back-scattering diffraction pattern method (EBSP). Then, based on the analysis results, boundaries on the observed surface having a crystal misorientation of 15° or larger are represented as a picture to allow identifying a plurality of sub-structures. The sub-structures may be identified by, for example, image processing using a computer.

The equivalent circle diameter of each identified sub-structure is measured. Equivalent circle diameter means the diameter of a circle having the same area as a sub-structure. The equivalent circle diameter may be measured by, for example, image processing. The equivalent circle diameter of sub-structures is defined as the average of the measured equivalent circle diameters of the sub-structures.

Figure 2:
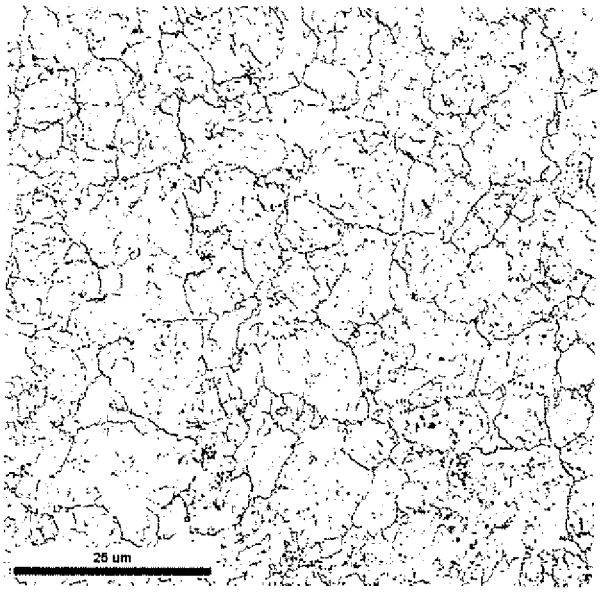
FIG. 2 is a prior austenite grain boundary map of a microstructure with sub-structures with a grain diameter of 2.6 μm.
Figure 3:
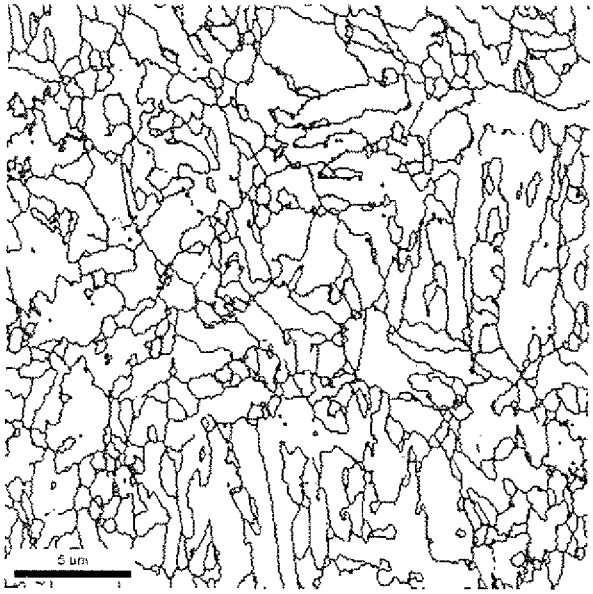
FIG. 3 is a large-angle grain boundary map of a microstructure with sub-structures with a grain diameter of 2.6 μm.

FIGS. 2 and 3 illustrate microstructures with sub-structures having a grain diameter of 2.6 μm. FIG. 2 is a prior austenite grain boundary map, and FIG. 3 is a large-angle grain boundary map. FIGS. 2 and 3 show microstructures obtained from a steel in which the crystal grain size number of the prior austenite grains is 10.5, C: 0.51%, Si: 0.31%, Mn: 0.47%, P: 0.012%, S: 0.0014%, Cu: 0.02%, Cr: 1.06%, Mo: 0.67%, V: 0.098%, Ti: 0.008%, Nb: 0.012%, Ca: 0.0018%, B: 0.0001%, sol. Al: 0.029%, and N: 0.0034%.

Figure 4:
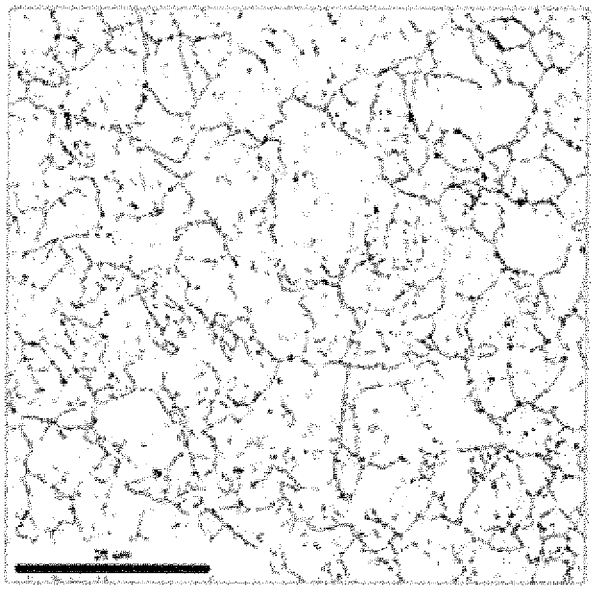
FIG. 4 is a prior austenite grain boundary map of a microstructure with sub-structures with a grain diameter of 4.1 μm.
Figure 5:
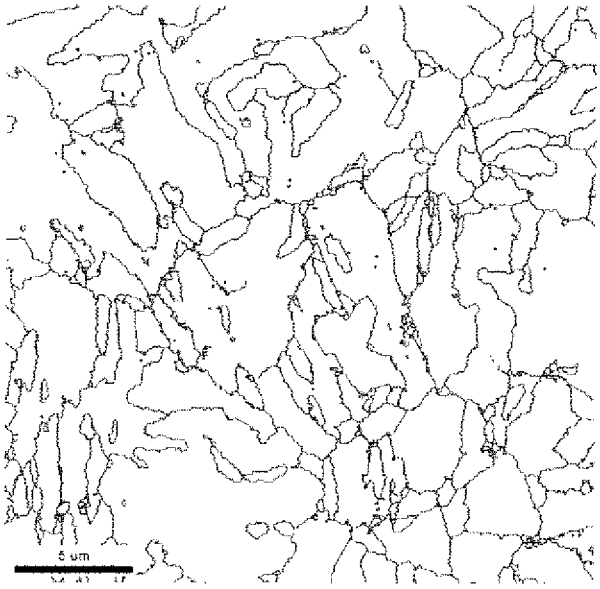
FIG. 5 is a large-angle grain boundary map of a microstructure with sub-structures with a grain diameter of 4.1 μm.

FIGS. 4 and 5 illustrate microstructures with sub-structures having a grain diameter of 4.1 μm. FIG. 4 is a prior austenite grain boundary map, and FIG. 5 is a large-angle grain boundary map. FIGS. 4 and 5 show microstructures obtained from a steel in which the crystal grain size number of the prior austenite grains is 11.5, C: 0.26%, Si: 0.19%, Mn: 0.82%, P: 0.013%, S: 0.0008%, Cu: 0.01%, Cr: 0.52%, Mo: 0.70%, V: 0.11%, Ti: 0.018%, Nb: 0.013%, Ca: 0.0001%, B: 0.0001%, sol. Al: 0.040%, and N: 0.0041%.

[Manufacturing Method]

A method of manufacturing the low-alloy steel oil well pipe in one embodiment of the present invention will now be described.

Figure 6:
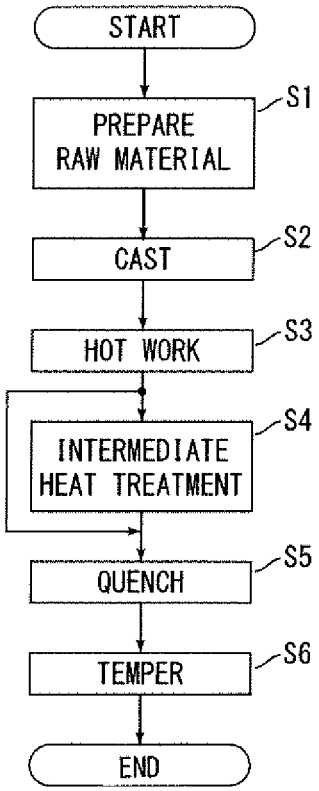
FIG. 6 is a flow chart illustrating a method of manufacturing a low-alloy steel oil well pipe in an embodiment of the present invention.

FIG. 6 is a flow chart of a method of manufacturing a low-alloy steel oil well pipe in the present embodiment. The method of manufacturing a low-alloy steel oil well pipe in the present embodiment includes the step of preparing a raw material (step S1), the step of casting the raw material to produce a cast material (step S2), the step of hot working the cast material to produce a hollow shell (step S3), the step of performing an intermediate heat treatment on the hollow shell (step S4), the step of quenching the hollow shell that has undergone the intermediate heat treatment (step S5), and the step of tempering the quenched hollow shell (step S6).

Raw material having the above-described chemical composition is prepared (step S1). More specifically, a steel having the above-described chemical composition is melt and refined.

The raw material is cast to produce a cast material (step S2). The casting may be continuous casting, for example. The cast material may be a slab, bloom or billet, for example. The cast material may be a continuously cast round billet.

During this, the cooling rate for the temperature range between 1500 and 1000° C. at a position of ¼ of the wall thickness of the cast material is 10° C./min or higher. If the cooling rate during this is too low, carbonitride-based inclusions become coarse. If the cooling rate during this is too high, cracks may develop on the surface of the cast material. In view of this, the cooling rate is preferably 50° C./min or lower, and more preferably 30° C./min or lower. The cooling rate at a position of ¼ of the wall thickness may be determined by simulation calculation. In actual manufacturing, rather, cooling conditions may be determined that will result in the appropriate cooling rate in advance using simulation calculation, and these conditions may be applied. Any cooling rate may be used for the temperature range lower than 1000° C.

As used herein, position of ¼ of the wall thickness means the position at the depth of ¼ of the thickness of the cast material, beginning with the surface of the cast material. For example, if the cast material is a round billet continuously cast, it means the position at the depth from the surface of one half of the radius; for a rectangular bloom, it means the position at the depth from the surface of one fourth of the length of a long side.

The cast material is bloomed or forged into a round billet shape. The round billet is hot worked to produce a hollow shell (step S3). Using a round billet continuously cast enables to omit blooming or forging process. Hot working may be, for example, Mannesmann pipe manufacturing process. More specifically, a round billet piercing machine is used to piercing-roll a round billet, and a mandrel mill, reducer, sizing mill and other machines are used for hot rolling to produce a hollow shell. Other hot working methods may be used to produce a hollow shell from a round billet.

The hollow shell produced by hot working may be subjected to an intermediate heat treatment (step S4). The intermediate heat treatment is an optional step. That is, an intermediate heat treatment does not have to be performed. Performing the intermediate heat treatment makes crystal grains (prior austenite grains) of the steel finer, further increasing SSC resistance.

The intermediate heat treatment may be normalizing, for example. More specifically, the hollow shell is kept at a temperature that is not lower than $Ac_3$ point, for example in the range of 850 to 950° C., for a certain period of time, and is then left to cool. The period of time for which the hollow shell is kept at a certain temperature may be 15 to 120 minutes, for example. Typically, normalizing is performed after the hollow shell is cooled to room temperature after hot working. Alternatively, in the present embodiment, the hollow shell may not be left to cool to room temperature after hot working, but kept at a temperature that is not lower than $Ac_3$ point and then left to cool.

Instead of normalizing, the intermediate heat treatment may be quenching. This quenching is a heat treatment that is different from the quenching in step S5. That is, in cases where quenching is performed as the intermediate heat treatment, quenching occurs a plurality of times. More specifically, the quenching is keeping the hollow shell at a temperature that is not lower than $Ac_3$ point, such as in the range of 850 to 950° C., for a certain period of time, and then cooing it rapidly. In these cases, the hollow shell may be rapidly cooled from the temperature that is not lower than $Ac_3$ point immediately after hot working (this process will be hereinafter referred to as "direct quenching").

The intermediate heat treatment may be a heat treatment at a two-phase range temperature for ferrite plus austenite (hereinafter referred to as "two-phase range heating"), which provides the same effects. During the intermediate heat treatment, preferred effects for making crystal grains finer are achieved if at least a portion of the microstructure of the steel transforms to austenite. Thus, during the intermediate heat treatment, it is preferable, at least, to soak the hollow shell at a temperature that is not lower than $Ac_1$ point.

The hollow shell that has undergone the intermediate heat treatment is quenched (step S5). In cases where no intermediate heat treatment is performed, the hollow shell produced by hot working (step S3) is quenched (step S5).

During the quenching, the quench start temperature is preferably not lower than $Ac_3$ point, and the quench stop temperature is preferably not higher than 100° C. That is, after the hollow shell is heated to a temperature that is not lower than $Ac_3$ point, the heated hollow shell is preferably cooled to a temperature that is not higher than 100° C. During this cooling, the cooling rate for the range from 500° C. to 100° C. is preferably not lower than 1° C./sec and lower than 15° C./sec. This makes the equivalent circle diameter of sub-structures equal to or smaller than 3 μm. If the cooling rate is lower than 1° C./sec, it is difficult to provide sub-structures with an equivalent circle diameter that is not larger than 3 μm. If the cooling rate is higher than 15° C./sec, quench cracks are more likely to occur. The lower limit of cooling rate is preferably 2° C./sec, and more preferably not lower than 5° C./sec.

The quenched hollow shell is tempered (step S6). More specifically, the quenched hollow shell is soaked at a tempering temperature that is lower than $Ac_1$ point. The tempering temperature is adjusted depending on the chemical composition of the hollow shell and the target yield strength. The tempering temperature is preferably not lower than 650° C. and lower than 700° C., and the soaking time is preferably 15 to 120 minutes. Higher tempering temperatures are preferable, but a tempering temperature lower than $Ac_1$ point should be used.

A low-alloy steel for oil well pipe and a method of manufacturing a low-alloy steel for oil well pipe in embodiments of the present invention have been described. The embodiments provide a low-alloy steel for oil well pipe and a low-alloy steel oil well pipe where high strengths and good SSC resistances can be achieved in a stable manner.

Examples

The present invention will be described in more detail by means of examples. The present invention is not limited to these examples.

Steels A to F having the chemical compositions shown in Table 1 were melt.

TABLE 1

| Steel | Chemical Composition (in mass %, balance Fe and impurities) | | | | | | | | | |
|---|---|---|---|---|---|---|---|---|---|---|
| | C | Si | Mn | P | S | Cu | Cr | Ni | Mo | Ti |
| A | 0.53 | 0.27 | 0.43 | 0.007 | 0.0010 | 0.01 | 0.52 | 0.01 | 0.68 | 0.006 |
| B | 0.50 | 0.26 | 0.43 | 0.006 | 0.0005 | 0.03 | 0.51 | 0.02 | 1.57 | 0.005 |
| C | 0.60 | 0.29 | 0.43 | 0.007 | 0.0005 | 0.01 | 0.52 | 0.04 | 0.71 | 0.005 |
| D | 0.51 | 0.31 | 0.47 | 0.012 | 0.0014 | 0.01 | 1.04 | 0.03 | 0.70 | 0.009 |
| E | 0.27 | 0.30 | 0.43 | 0.005 | 0.0009 | 0.01 | 0.49 | 0.03 | 0.68 | 0.016 |
| F | 0.27 | 0.28 | 0.46 | 0.010 | 0.0005 | 0.01 | 0.50 | 0.03 | 0.68 | 0.005 |

| Steel | Chemical Composition (in mass %, balance Fe and impurities) | | | | | | |
|---|---|---|---|---|---|---|---|
| | V | Nb | Al | B | Ca | O | N |
| A | 0.088 | 0.031 | 0.029 | <0.0001 | <0.0001 | 0.0009 | 0.0038 |
| B | 0.090 | 0.033 | 0.033 | <0.0001 | <0.0001 | 0.0009 | 0.0051 |
| C | 0.090 | 0.030 | 0.039 | <0.0001 | <0.0001 | 0.0008 | 0.0034 |
| D | 0.100 | 0.013 | 0.030 | <0.0001 | 0.0018 | 0.0007 | 0.0026 |
| E | 0.090 | 0.013 | 0.047 | 0.0012 | 0.0015 | 0.0008 | 0.0027 |
| F | 0.090 | 0.012 | 0.040 | <0.0001 | 0.0010 | 0.0014 | 0.0036 |

From steels A to F, a plurality of round billets with an outer diameter of 310 mm were produced using round continuous casting, or blooms were obtained by continuous casting and were hot worked to produce a plurality of round billets with an outer diameter of 310 mm. From the round billets, hollow shells were produced by hot working. More specifically, after the round billets were heated by a heating furnace to a temperature ranging from 1150 to 1200° C., they were piercing-rolled by a piercing machine, elongation-rolled by a mandrel mill, and sizing-rolled by a reducer to produce hollow shells. The hollow shells were subjected to a variety of heat treatments to produce low-alloy steel oil well pipes with number 1 to 44. These low-alloy steel oil well pipes had an outer diameter of 244.48 mm and a wall thickness of 13.84 mm. Table 2 shows manufacturing conditions for these low-alloy steel oil well pipes.

TABLE 2

| No | Steel | Casting Condition | Intermediate Heat Treatment | Quenching Conditions | | | | Tempering Conditions | |
|---|---|---|---|---|---|---|---|---|---|
| | | | | Soaking Temp. (° C.) | Stop Temp. (° C.) | Method | Cooling Rate (° C./sec) | Soaking Temp. (° C.) | Soaking Time (min) |
| 1 | A | o | norm. 920° C. | 900 | 75 | mist Q | 5 | 680 | 45 |
| 2 | A | o | norm. 920° C. | 900 | 75 | mist Q | 5 | 680 | 30 |
| 3 | A | x | norm. 920° C. | 900 | 75 | mist Q | 5 | 680 | 30 |
| 4 | A | o | norm. 920° C. | 900 | 75 | mist Q | 5 | 680 | 60 |
| 5 | A | x | norm. 920° C. | 900 | 75 | mist Q | 5 | 680 | 60 |
| 6 | A | o | norm. 920° C. | 900 | 75 | mist Q | 5 | 700 | 45 |
| 7 | A | o | norm. 920° C. | 900 | 75 | mist Q | 5 | 710 | 30 |
| 8 | A | o | norm. 920° C. | 900 | 75 | mist Q | 5 | 710 | 45 |
| 9 | A | o | norm. 920° C. | 900 | 75 | mist Q | 5 | 710 | 60 |
| 10 | B | o | norm. 920° C. | 900 | 75 | mist Q | 5 | 680 | 30 |
| 11 | B | o | norm. 920° C. | 900 | 75 | mist Q | 5 | 680 | 45 |
| 12 | B | x | norm. 920° C. | 900 | 75 | mist Q | 5 | 680 | 45 |
| 13 | B | o | norm. 920° C. | 900 | 75 | mist Q | 5 | 680 | 30 |
| 14 | B | x | norm. 920° C. | 900 | 75 | mist Q | 5 | 680 | 30 |
| 15 | B | o | norm. 920° C. | 900 | 75 | mist Q | 5 | 700 | 30 |
| 16 | B | o | norm. 920° C. | 900 | 75 | mist Q | 5 | 700 | 45 |
| 17 | B | o | norm. 920° C. | 900 | 75 | mist Q | 5 | 700 | 60 |
| 18 | B | o | norm. 920° C. | 900 | 75 | mist Q | 5 | 710 | 30 |
| 19 | C | o | norm. 920° C. | 900 | 75 | mist Q | 2 | 680 | 30 |
| 20 | C | x | norm. 920° C. | 900 | 75 | mist Q | 2 | 680 | 30 |
| 21 | C | o | norm. 920° C. | 900 | 75 | mist Q | 2 | 680 | 45 |
| 22 | C | x | norm. 920° C. | 900 | 75 | mist Q | 2 | 680 | 45 |
| 23 | C | o | norm. 920° C. | 900 | 75 | mist Q | 2 | 700 | 45 |
| 24 | C | o | norm. 920° C. | 900 | 75 | mist Q | 2 | 695 | 30 |
| 25 | C | o | norm. 920° C. | 900 | 75 | mist Q | 2 | 700 | 30 |
| 26 | E | o | in-line Q | 920 | 50 | WQ | 20 | 685 | 60 |
| 27 | E | o | in-line Q | 920 | 50 | WQ | 20 | 685 | 55 |
| 28 | E | o | in-line Q | 920 | 50 | WQ | 20 | 685 | 50 |
| 29 | E | o | in-line Q | 920 | 50 | WQ | 20 | 680 | 60 |
| 30 | E | o | in-line Q | 920 | 50 | WQ | 20 | 680 | 50 |
| 31 | E | o | in-line Q | 920 | 50 | WQ | 20 | 675 | 60 |
| 32 | E | o | in-line Q | 920 | 50 | WQ | 20 | 675 | 55 |
| 33 | A | o | — | 900 | 75 | mist Q | 5 | 680 | 45 |
| 34 | A | x | — | 900 | 75 | mist Q | 5 | 680 | 45 |
| 35 | D | o | — | 900 | 75 | mist Q | 5 | 680 | 30 |
| 36 | D | x | — | 900 | 75 | mist Q | 5 | 680 | 30 |

TABLE 2-continued

| No | Steel | Casting Condition | Intermediate Heat Treatment | Quenching Conditions: Soaking Temp. (° C.) | Stop Temp. (° C.) | Method | Cooling Rate (° C./sec) | Tempering Conditions: Soaking Temp. (° C.) | Soaking Time (min) |
|---|---|---|---|---|---|---|---|---|---|
| 37 | D | ○ | norm. 920° C. | 900 | 75 | mist Q | 5 | 680 | 30 |
| 38 | D | ○ | norm. 920° C. | 900 | 75 | mist Q | 5 | 680 | 45 |
| 39 | D | ○ | norm. 920° C. | 900 | 75 | mist Q | 5 | 680 | 60 |
| 40 | D | x | norm. 920° C. | 900 | 75 | mist Q | 5 | 680 | 60 |
| 41 | A | ○ | norm. 920° C. | 890 | 150 | mist Q | 5 | 660 | 60 |
| 42 | A | ○ | norm. 920° C. | 890 | 65 | mist Q | 20 | — | — |
| 43 | A | ○ | norm. 920° C. | 890 | 65 | mist Q | 0.8 | 670 | 60 |
| 44 | F | ○ | in-line Q | 920 | 50 | WQ | 20 | 640 | 40 |

In Table 2, "○" in the column "Casting Condition" indicates that the cooling rate for the range of 1500 to 1000° C. was 10 to 30° C./min. "x" in this column indicates that the cooling rate for the same temperature range was below 10° C./min. "Norm. 920° C." in the column "Intermediate Heat Treatment" indicates that normalizing at a soaking temperature of 920° C. was performed as the intermediate treatment. "In-line Q" in the column "Intermediate Heat Treatment" indicates that, as the intermediate heat treatment, quenching was performed where, when the hollow shell temperature after hot working was still higher than $Ar_3$ point, the hollow shell was soaked at 920° C. and water-cooled. "-" in the column "Intermediate Heat Treatment" indicates that no intermediate heat treatment was performed. "Mist Q" in the column "Method" of "Quenching Conditions" indicates that mist cooling was performed as the cooling for quenching. "WQ" in this column indicates that water-cooling was performed as the cooling for quenching. "-" in the column "Tempering Condition" indicates that tempering was not performed. The low-alloy steel oil well pipe of No. 42 was not tempered because cracking occurred during quenching.

[Tensile Test]

From the low-alloy steel oil well pipe of each number, an arched tensile test specimen was obtained. The arched tensile test specimen had an arc-shaped cross-section, and the longitudinal direction of the arched tensile test specimen was parallel to the longitudinal direction of the steel pipe. The arched tensile test specimen was used to conduct a tensile test at room temperature in accordance with 5CT of the American Petroleum Institute (API) standard. Based on the test results, the yield strength YS (MPa), tensile strength TS (MPa) and yield ratio YR (%) of each steel pipe were determined.

[DCB Test]

From the low-alloy steel oil well pipe of each number, a DCB test specimen was obtained having a thickness of 9.53±0.05 mm, a width of 25.4±0.05 mm and a length of 101.6±1.59 mm. The obtained DCB test specimen was used to conduct a DCB test in accordance with TM0177-2005, Method D of the National Association of Corrosion Engineers (NACE). The testing bath was an aqueous solution of 50 g/L NaCl+4 g/L $CH_3COONa$ at room temperature which was saturated with hydrogen sulfide gas at 0.03 atm. The pH of the testing bath was adjusted to 3.5 by adding hydrochloric acid. The DCB test specimen was immersed in the testing bath for 720 hours to conduct a DCB test. The test specimen was placed under an opening stress using a wedge for applying a displacement of 0.51 mm (+0.03/−0.05 mm) to the two arms of the DCB test specimen and was exposed to a testing liquid for 30 days. After the test, the extension of a fissure, a, that had developed in the DCB test specimen was measured. The stress intensity factor $K_{ISSC}$ (ksi √ inch) was determined based on the measured fissure extension a and the wedge opening stress P in accordance with Equation (B). In Equation (B), h is the height of the arms of the DCB test specimen, B is the thickness of the DCB test specimen, and Bn is the web thickness of the DCB test specimen. This is defined in NACE TM0177-2005, Method D.

[Equation 1]

$$K_{ISSC} = \frac{Pa(2\sqrt{3} + 2.38\,h/a)(B/B_n)^{1/\sqrt{3}}}{Bh^{3/2}}. \quad \text{(B)}$$

[Observation of Microstructure]

A sample was obtained from the central portion with respect to the wall thickness of the low-alloy steel oil well pipe of each number and the volume fraction of retained austenite was measured by X-ray diffraction method.

[Counting of Inclusions]

A test specimen to be used to determine the amount of inclusions was obtained from each low-alloy steel oil well pipe, where each test specimen had a polished surface that extended parallel to the direction of rolling and contained the center of the steel pipe with respect to the wall thickness. The obtained test specimen was observed at a magnification of 200 times. A cluster-like object was measured at a magnification of 200 to 1000 times to determine whether it was a cluster. The number of carbonitride-based inclusions having a grain diameter of 50 μm or larger and the number of carbonitride-based inclusions having a grain diameter of 5 μm or larger were measured, each based on two viewing fields. Each measured number was divided by the area of the relevant viewing field to provide a number density, and the larger one of the number densities for the two viewing fields was used as the number density of the carbonitride-based inclusions in the low-alloy steel oil well pipe.

[Prior Austenite Crystal Grain Size Testing]

From the low-alloy steel oil well pipe of each number, a test specimen having a surface perpendicular to the axial direction (hereinafter referred to as observed surface) was obtained. The observed surface of each test specimen was mechanically polished. After polishing, Picral etching reagent was used to cause prior austenite crystal grain boundaries on the observed surface to appear. Thereafter, the crystal grain size number of the prior austenite grains on the observed surface was determined in accordance with ASTM E112.

[Measurement of Equivalent Circle Diameter of Sub-Structures]

A sample was obtained from a cross-section of the low-alloy steel oil well pipe of each number and crystal orientation analysis was conducted using EBSP to determine the equivalent circle diameter of sub-structures.

The results of these tests are shown in Table 3. The low-alloy steel oil well pipes of all the numbers had a microstructure composed of tempered martensite and austenite in less than 2% by volume fraction.

TABLE 3

| | Tansile Test | | | | | DCB | | Carbonitride-Based Inclusions | | Prior γ | Equivalent Circle Diameter of |
|---|---|---|---|---|---|---|---|---|---|---|---|
| | YS | | TS | | YR | Klssc | | (inclusions/100 mm$^2$) | | Grain | Sub-Structures |
| No | (ksi) | (MPa) | (ksi) | (MPa) | (%) | (ksi√inch) | (MPa√m) | ≥5 μm | ≥50 μm | No. | (μm) |
| 1 | 141.0 | 972.2 | 153.7 | 1059.7 | 91.7 | 24.4 | 26.8 | 568 | 8 | 10.7 | 2.2 |
| 2 | 149.2 | 1028.7 | 160.6 | 1107.3 | 92.9 | 23.4 | 25.7 | 584 | 5 | 10.7 | 2.1 |
| 3 | 149.2 | 1028.7 | 157.7 | 1087.3 | 94.6 | 20.0 | 22.0 | 631 | 11 | 10.8 | 2.0 |
| 4 | 143.4 | 988.7 | 152.0 | 1048.0 | 94.4 | 23.9 | 26.3 | 583 | 2 | 10.3 | 2.3 |
| 5 | 142.1 | 979.7 | 152.0 | 1048.0 | 93.5 | 20.9 | 23.0 | 673 | 11 | 10.8 | 2.3 |
| 6 | 128.6 | 886.7 | 139.2 | 959.7 | 92.4 | 33.7 | 37.0 | — | — | 10.6 | 2.6 |
| 7 | 126.5 | 872.2 | 137.8 | 950.1 | 91.8 | 34.3 | 37.7 | — | — | 10.8 | 2.7 |
| 8 | 122.1 | 841.8 | 133.6 | 921.1 | 91.4 | 39.8 | 43.7 | — | — | 10.5 | 2.6 |
| 9 | 120.8 | 832.9 | 132.1 | 910.8 | 91.4 | 42.7 | 46.9 | — | — | 10.5 | 2.8 |
| 10 | 153.4 | 1057.7 | 162.0 | 1116.9 | 94.7 | 25.0 | 27.5 | 521 | 2 | 10.5 | 1.9 |
| 11 | 140.5 | 968.7 | 151.1 | 1041.8 | 93.0 | 27.7 | 30.4 | 544 | 5 | 11.3 | 2.1 |
| 12 | 140.0 | 965.3 | 150.6 | 1038.3 | 93.0 | 21.6 | 23.7 | 872 | 11 | 11.3 | 2.1 |
| 13 | 149.0 | 1027.3 | 158.7 | 1094.2 | 93.9 | 24.4 | 26.8 | 363 | 3 | 11.4 | 1.9 |
| 14 | 148.7 | 1025.2 | 158.7 | 1094.2 | 93.7 | 20.2 | 22.2 | 658 | 13 | 11.3 | 1.8 |
| 15 | 132.4 | 912.9 | 142.4 | 981.8 | 93.0 | 31.7 | 34.8 | — | — | 11.4 | 2.4 |
| 16 | 130.0 | 896.3 | 140.0 | 965.3 | 92.9 | 33.9 | 37.3 | — | — | 11.3 | 2.3 |
| 17 | 127.2 | 877.0 | 136.3 | 939.8 | 93.3 | 36.7 | 40.3 | — | — | 11.4 | 2.4 |
| 18 | 126.5 | 872.2 | 136.3 | 939.8 | 92.8 | 35.1 | 38.6 | — | — | 11.3 | 2.5 |
| 19 | 146.1 | 1007.3 | 159.1 | 1097.0 | 91.8 | 24.9 | 27.4 | 599 | 2 | 10.7 | 1.7 |
| 20 | 145.5 | 1003.2 | 159.1 | 1097.0 | 91.4 | 21.0 | 23.1 | 1063 | 32 | 10.6 | 1.8 |
| 21 | 141.6 | 976.3 | 154.6 | 1065.9 | 91.2 | 25.8 | 28.4 | 540 | 9 | 10.8 | 2.0 |
| 22 | 141.0 | 972.2 | 154.6 | 1065.9 | 91.6 | 20.8 | 22.9 | 1057 | 54 | 10.8 | 2.0 |
| 23 | 126.5 | 972.2 | 139.5 | 961.8 | 90.7 | 33.5 | 36.8 | — | — | 10.6 | 2.3 |
| 24 | 134.2 | 925.3 | 147.2 | 1014.9 | 91.2 | 31.7 | 34.5 | — | — | 10.7 | 2.1 |
| 25 | 130.1 | 897.0 | 142.6 | 983.2 | 91.2 | 32.7 | 35.9 | — | — | 10.8 | 2.2 |
| 26 | 127.6 | 879.8 | 136.9 | 943.9 | 93.2 | 29.9 | 32.9 | — | — | 9.4 | 4.3 |
| 27 | 128.4 | 885.3 | 139.4 | 961.1 | 92.1 | 24.5 | 26.9 | — | — | 9.3 | 4.1 |
| 28 | 129.9 | 895.6 | 895.6 | 970.1 | 92.3 | 26.9 | 29.6 | — | — | 9.3 | 4.5 |
| 29 | 130.5 | 899.8 | 139.8 | 963.9 | 93.3 | 29.9 | 32.9 | — | — | 9.2 | 4.0 |
| 30 | 131.4 | 906.0 | 141.6 | 976.3 | 92.8 | 24.0 | 26.4 | — | — | 9.4 | 4.0 |
| 31 | 132.5 | 913.6 | 142.4 | 981.8 | 93.0 | 26.0 | 28.6 | — | — | 9.3 | 3.7 |
| 32 | 132.9 | 916.3 | 141.6 | 976.3 | 93.9 | 24.2 | 26.6 | — | — | 9.5 | 3.6 |
| 33 | 142.7 | 983.9 | 159 1 | 1097.0 | 89.7 | 23.8 | 26.2 | 571 | 6 | 9.5 | 2.8 |
| 34 | 142.0 | 979.1 | 158.3 | 1091.4 | 89.7 | 20.8 | 22.9 | 672 | 13 | 9.5 | 2.8 |
| 35 | 145.6 | 1003.9 | 162.1 | 1121.8 | 89.5 | 23.2 | 25.5 | 588 | 8 | 9.6 | 2.5 |
| 36 | 144.8 | 998.4 | 161.8 | 1115.6 | 89.5 | 19.8 | 21.8 | 661 | 12 | 9.6 | 2.7 |
| 37 | 148.4 | 1023.2 | 158.1 | 1090.1 | 93.9 | 23.0 | 25.3 | 553 | 7 | 10.4 | 1.8 |
| 38 | 144.7 | 997.7 | 154.9 | 1068.0 | 93.4 | 24.2 | 26.6 | 535 | 3 | 10.4 | 2.1 |
| 39 | 141.2 | 973.5 | 151.6 | 1045.2 | 93.1 | 24.5 | 26.9 | 564 | 6 | 10.5 | 2.3 |
| 40 | 141 0 | 972.2 | 151.1 | 1041.8 | 93.3 | 21.2 | 23.3 | 629 | 14 | 10.4 | 2.3 |
| 41 | 147.9 | 1020.0 | 159.1 | 1097.0 | 93.0 | 20.0 | 22.0 | 572 | 3 | 11.0 | 3.2 |
| 42 | — | — | — | — | — | — | — | — | — | — | — |
| 43 | 145.8 | 1005.0 | 166.8 | 1150.0 | 87.4 | 19.0 | 20.9 | 566 | 5 | 10.0 | 4.2 |
| 44 | 140.5 | 968.7 | 150.1 | 1034.9 | 93.6 | 20.3 | 22.3 | — | — | 9.1 | 4 |

The column "YS" of Table 3 lists yield strengths, the column "TS" lists tensile strengths, and the column "YR" lists yield ratios. The column "Prior y Grain Number" lists crystal grain size numbers of prior austenite grains. "-" in columns in Table 3 indicates that the relevant test or measurement was not conducted.

The low-alloy steel oil well pipes of Nos. 1, 2, 4, 10, 11, 13, 19, 21, 33, 35 and 37 to 39 had yield strengths not smaller than 140 ksi (i.e. 965 MPa) and stress intensity factors not smaller than 22 ksi√ inch. In each of the low-alloy steel oil well pipes of these numbers, the number density of carbonitride-based inclusions having a grain diameter equal to or larger than 50 μm was not more than 10 inclusions/100 mm$^2$, and the number density of carbonitride-based inclusions having a grain diameter equal to or larger than 5 μm was not more than 600 inclusions/100 mm$^2$.

The low-alloy steel oil well pipes of Nos. 6 to 9, 15 to 18 and 23 to 25 had yield strengths lower than 140 ksi. This is presumably because the tempering temperatures were too high.

The low-alloy steel oil well pipes of Nos. 26 to 32 had yield strengths lower than 140 ksi. This is presumably because steel E had a too low carbon content.

In each of the low-alloy steel oil well pipes of Nos. 3, 5, 12, 14, 20, 22, 34, 36 and 40, the yield strength was not smaller than 140 ksi; however, the stress intensity factor was smaller than 22 ksi√ inch. This is presumably because the number density of carbonitride-based inclusions having a grain diameter of 50 μm or larger was more than 10 inclusions/100 mm$^2$, or the number density of carbonitride-based inclusions having a grain diameter of 5 μm or larger was more than 600 inclusions/100 $mm^2$. The number density of coarse carbonitride-based inclusions was high presumably because the cooling rates during the casting step were too low.

In each of the low-alloy steel oil well pipes of Nos. 41, 43, and 44, the yield strength was not lower than 140 ksi; however, the stress intensity factor was smaller than 22 ksi√inch. This is presumably because the equivalent circle diameter of sub-structures was larger than 3 μm. The equivalent circle diameter of sub-structures was larger than 3 μm presumably because the quenching conditions were inappropriate. In the low-alloy steel oil well pipe of No. 42, cracks developed during quenching. This is presumably because the cooling rate during quenching was too high.

What is claimed is:

1. A low-alloy steel for oil well pipe, having a chemical composition consisting of, by mass percent, C: more than 0.45 and up to 0.65%;
Si: 0.05 to 0.50%;
Mn: 0.10 to 1.00%;
P: up to 0.020%;
S: up to 0.0020%;
Cu: up to 0.1%;
Cr: 0.40 to 1.50%;
Ni: up to 0.1%;
Mo: 0.50 to 2.50%;
Ti: up to 0.01%;
V: 0.05 to 0.25%;
Nb: 0.005 to 0.20%;
Al: 0.010 to 0.100%;
B: up to 0.0005%;
Ca: 0 to 0.003%;
O: up to 0.01%;
N: up to 0.007%; and
the balance: Fe and impurities, the steel having a microstructure consisting of tempered martensite and retained austenite in less than 2% in volume fraction, a crystal grain size number of prior austenite grains of the microstructure being 9.0 or larger, a number density of carbonitride-based inclusions with a grain diameter of 50 μm or larger being 10 inclusions/100 $mm^2$ or smaller, and a yield strength being 965 MPa or higher.

2. The low-alloy steel for oil well pipe according to claim 1, wherein a number density of carbonitride-based inclusions with a grain diameter of 5 μm or larger is 600 inclusions/100 $mm^2$ or smaller.

3. The low-alloy steel for oil well pipe according to claim 1, wherein an equivalent circle diameter of sub-structures defined by those boundaries between packets, blocks and laths in the tempered martensite that have a crystal misorientation of 15° or larger is 3 μm or smaller.

4. A method of manufacturing a low-alloy steel oil well pipe, the low-alloy steel oil well pipe, comprising:

preparing a raw material having a chemical composition consisting of, by mass percent, C: more than 0.45 and up to 0.65%; Si: 0.05 to 0.50%; Mn: 0.10 to 1.00%; P: up to 0.020%; S: up to 0.0020%; Cu: up to 0.1%; Cr: 0.40 to 1.50%; Ni: up to 0.1%; Mo: 0.50 to 2.50%; Ti: up to 0.01%; V: 0.05 to 0.25%; Nb: 0.005 to 0.20%; Al: 0.010 to 0.100%; B: up to 0.0005%; Ca: 0 to 0.003%; 0: up to 0.01%; N: up to 0.007%; and the balance: Fe and impurities;

casting the raw material to produce a cast material;

hot working the cast material to produce a hollow shell;

quenching the hollow shell; and tempering the quenched hollow shell to manufacture the low-alloy steel for oil well pipe according to claim 1, wherein, in the casting, a cooling rate for a temperature range of 1500 to 1000° C. at a position of ¼ of a wall thickness of the cast material is 10° C./min or higher.

5. The method of manufacturing a low-alloy steel oil well pipe according to claim 4, wherein, in the casting, the cooling rate for the temperature range of 1500 to 1000° C. at the position of ¼ of the wall thickness of the cast material is 30° C./min or lower.

6. The method of manufacturing a low-alloy steel oil well pipe according to claim 4, wherein the quenching includes:

heating the hollow shell to a temperature equal to or higher than $Ac_3$ point; and cooling the heated hollow shell to a temperature equal to or lower than 100° C., in the cooling, a cooling rate for a temperature range from 500° C. to 100° C. is equal to or higher than 1° C./sec and lower than 15° C./sec.

7. The low-alloy steel for oil well pipe according to claim 2, wherein an equivalent circle diameter of sub-structures defined by those boundaries between packets, blocks and laths in the tempered martensite that have a crystal misorientation of 15° or larger is 3 μm or smaller.

8. The method of manufacturing a low-alloy steel oil well pipe according to claim 5, wherein the quenching includes:

heating the hollow shell to a temperature equal to or higher than $Ac_3$ point; and cooling the heated hollow shell to a temperature equal to or lower than 100° C., in the cooling, a cooling rate for a temperature range from 500° C. to 100° C. is equal to or higher than 1° C./sec and lower than 15° C./sec.

9. The low-alloy steel for oil well pipe according to claim 1, wherein the C content of the chemical composition is 0.51 to 0.65.

* * * * *